US007731892B2

(12) United States Patent
Napoli et al.

(10) Patent No.: US 7,731,892 B2
(45) Date of Patent: Jun. 8, 2010

(54) PIT FURNACE CLOSING SYSTEM

(76) Inventors: Rodolfo Napoli, Rus Oswalde Russi, 161, Sao Bernardo de Campo, Sao Paulo, 09726-080 (BR); Massaco Simoyama Napoli, Rus Oswalde Russi, 161, Sao Bernardo de Campo, Sao Paulo, 09726-080 (BR)

( * ) Notice: Subject to any disclaimer, the term of this patent is extended or adjusted under 35 U.S.C. 154(b) by 408 days.

(21) Appl. No.: 10/587,851

(22) PCT Filed: Jan. 21, 2005

(86) PCT No.: PCT/BR2005/000007

§ 371 (c)(1),
(2), (4) Date: Jul. 28, 2006

(87) PCT Pub. No.: WO2005/073413

PCT Pub. Date: Aug. 11, 2005

(65) Prior Publication Data

US 2008/0224367 A1 Sep. 18, 2008

(30) Foreign Application Priority Data

Jan. 30, 2004 (BR) ..... 0400619
Apr. 26, 2004 (BR) ..... 0400619

(51) Int. Cl.
*C21D 9/70* (2006.01)

(52) U.S. Cl. ..... 266/286; 432/250

(58) Field of Classification Search ..... 266/252, 266/280, 286; 432/250
See application file for complete search history.

(56) References Cited

U.S. PATENT DOCUMENTS 3,658,373 A * 4/1972 Elkow et al. ..... 294/68.3
3,853,077 A * 12/1974 Malovich ..... 432/250

* cited by examiner

*Primary Examiner*—Scott Kastler
(74) *Attorney, Agent, or Firm*—Cantor Colburn LLP

(57) ABSTRACT

A PIT FURNACE CLOSING SYSTEM is provided having two beams laid across the border of the furnace and square iron bars supported over the beams, and pieces of cloth wrap for high temperature are used for closing the furnace or a box in a stainless steel screen, folded and having a ring, and filled in with remains of wraps, or a bipartite lid in a thin plate with wraps fixed to it and a cut for the upper part of the supporting device of the parts to pass, which is "cage"-like, and suspended inside the furnace and supported on the two beams, not resting on the floor of the furnace, and the furnace has thermopairs, and their heating ends are located in the central direction of each heating zone.

6 Claims, 10 Drawing Sheets

PIT FURNACE CLOSING SYSTEM

BACKGROUND OF THE INVENTION

The present invention of Pit Furnace Closing System, with innovative concept and having important technological and functional improvements, in accordance with the most modern concepts of engineering and in conformity with the required rules and specifications, and which greatly differs from the other lid systems used in the conventional furnaces, so as to provide many technical advantages, both practical and economical.

BRIEF SUMMARY OF THE INVENTION

An object of the present invention is to provide an improved furnace closing system that allows objects to be suspended securely inside, yet easily removed.

The instant pit furnace includes a support which the parts to be submitted to the high temperature are placed, in suspension, for the purposes of tempering.

Two beams are disposed in spaced parallel relation above the furnace structure, and one is selected from the following:

(1) stainless steel bars are supported over the beams with pieces of cloth wrap for high temperature being used to close the furnace;

(2) a bipartite lid having a cut, a planar stainless steel screen is formed to mate with the cut of the bipartite lid, the planar stainless steel screen having a through-hole formed therethrough; or, (3) a planar stainless steel screen supported on the two beams and having a through-hole formed therethrough; and, a support device hanging with a superior portion extending out of the furnace structure, the superior portion being substantially removed from the heat of the furnace structure, wherein, parts to be tempered are suspended on an inferior portion of the support device inside the furnace.

DESCRIPTION OF THE PRIOR ART

In the conventional system, the parts are always supported or hung in a device having the shape of a basket, or similar to a tree, with a central axis having several beams, said parts hung in these beams. This basket or tree may be supported in the floor of the furnace.

The state of the current technique is depicted in FIG. 1, which illustrates, in a schematic manner, a pit furnace of the conventional type, which is formed by a structure (6), which is closed by a lid (7), in which an engine is mounted (8), used for activating the air recirculator (helix) (9), and, the star-like support basis is mounted inside the furnace structure (10) itself.

The conventional pit furnace with lid system, the structure of which is indicated by the reference 6 has a lid 7 that consists of a part similar to a cork, in the due proportions, that is, a lid made of A1020" steel plate with coating of bricks, and the lower plate must be A310" stainless steel, having linked an engine 8 to said lid for driving the helix 9, which is destined to promote the recirculation of the hot air inside the closed furnace.

The conventional pit furnace, as may be verified in FIG. 1, presents a more complex construction, as well as a more expensive one, further counting on a star-like support 10, which is mounted on a basis of said support indicated by the numerical reference 11.

In the system belonging to the state of the technique, the parts are always supported or hung in a basket-like device, similar to a tree, with a central axis having several beams, being said parts hung in these beams. This basket or tree may be supported on the floor of the furnace.

BRIEF DESCRIPTION OF THE DRAWINGS

In face of the state of the technique described above, the present invention of Pit Furnace Closing System is being proposed, which will be related with reference to the drawings listed below, in which.

FIGS. from 3 through 18 illustrate views of variants for the device that conditions the part to be worked on inside the pit furnace in reference.

DETAILED DESCRIPTION OF THE PREFERRED EMBODIMENTS

Figure 1:
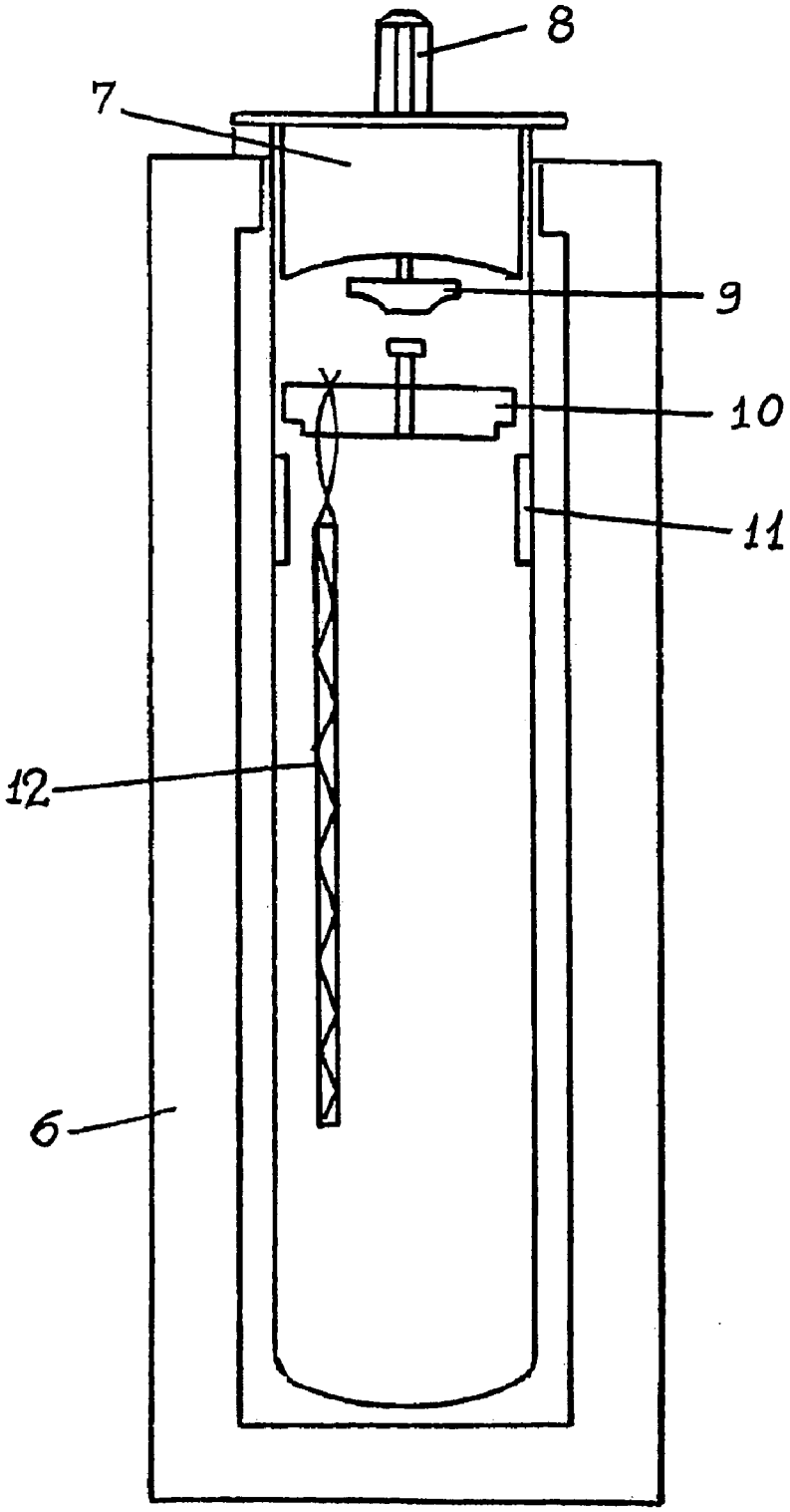
FIG. 1 PRIOR ART
FIG. 1 illustrates a schematic view of a pit furnace of the conventional type.
Figure 2:
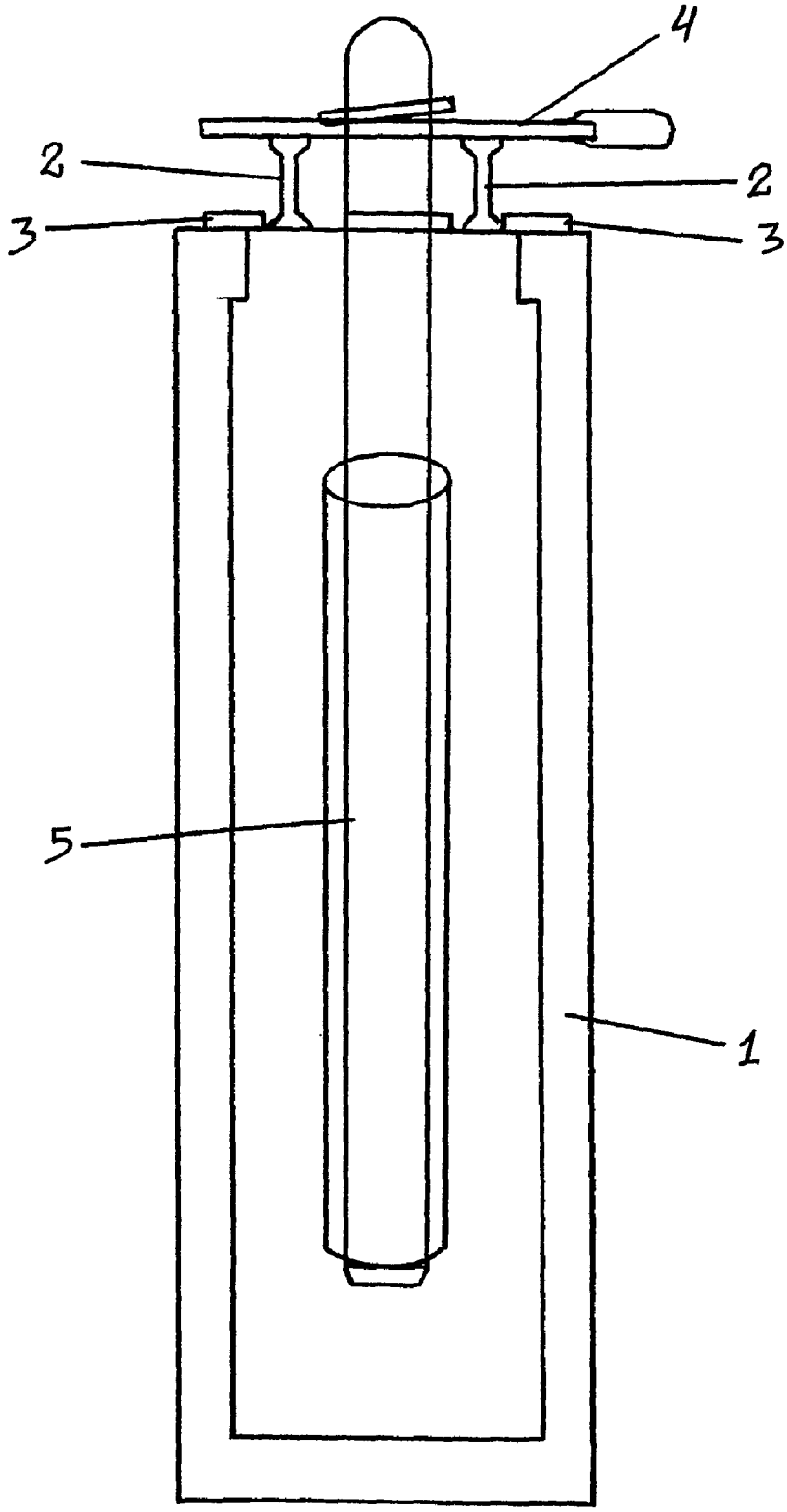
FIG. 2 illustrates a schematic view of a proposed pit furnace and its closing system.
Figure 3:
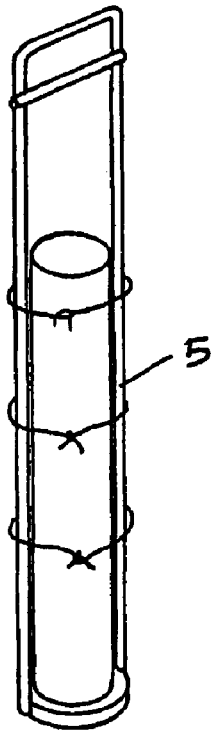
Figure 4:
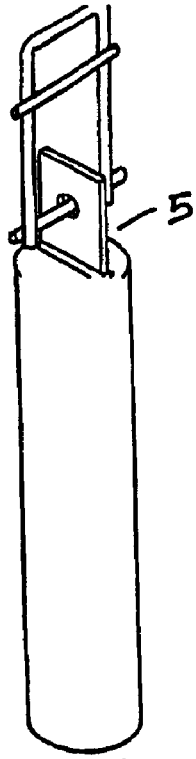
Figure 5:
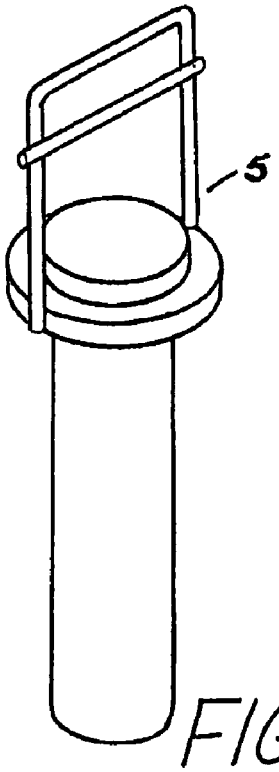
Figure 6:
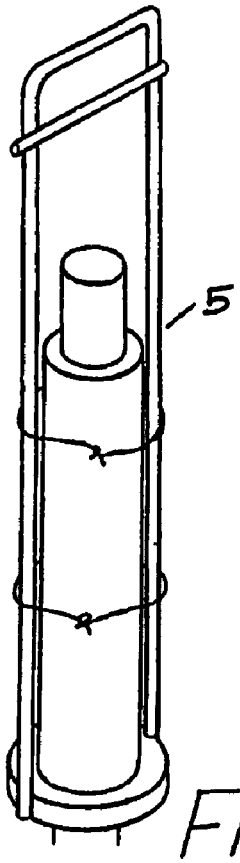
Figure 7:
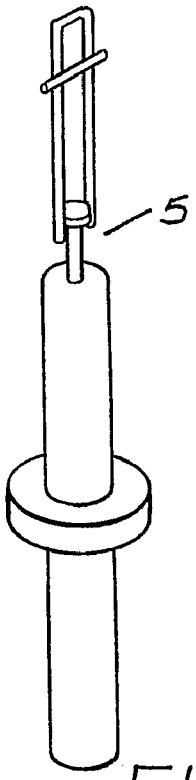
Figure 8:
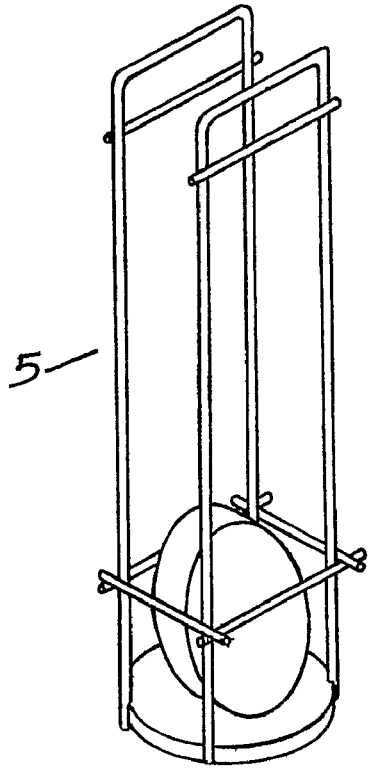
Figure 9:
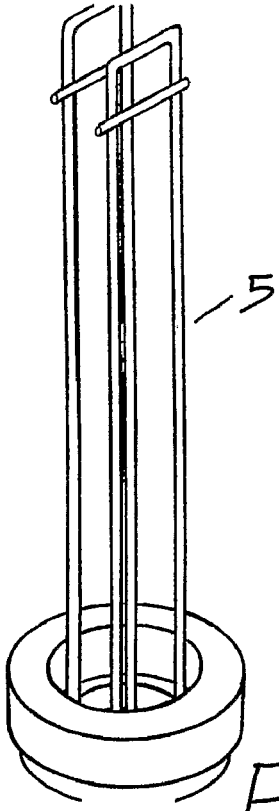
Figure 10:
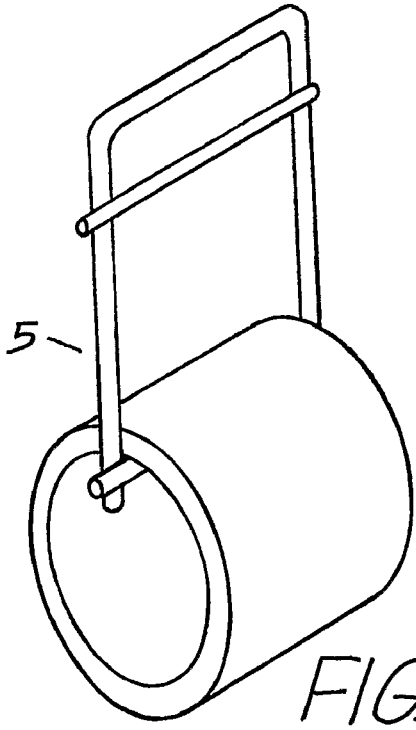
Figure 11:
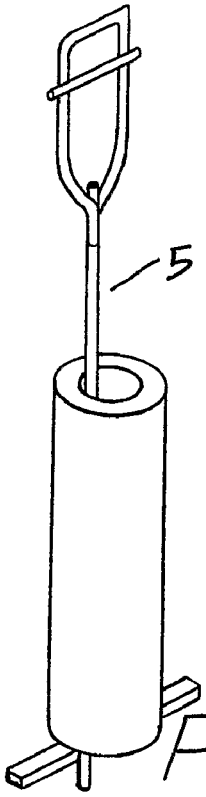
Figure 12:
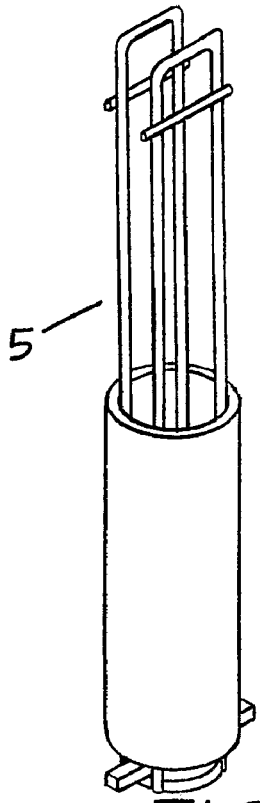
Figure 13:
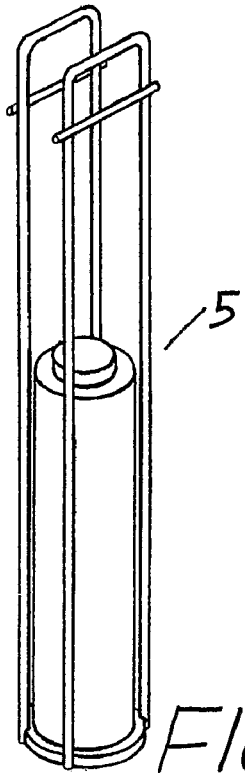
Figure 14:
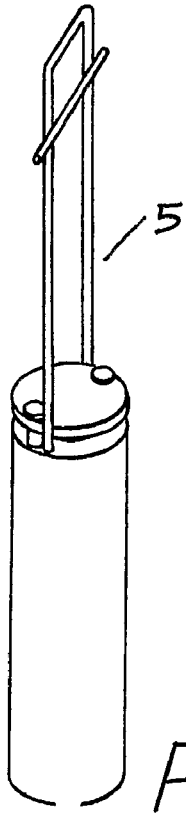
Figure 15:
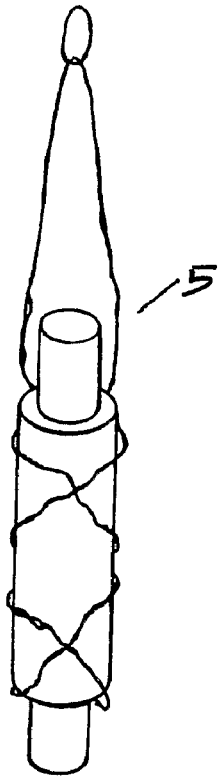
Figure 16:
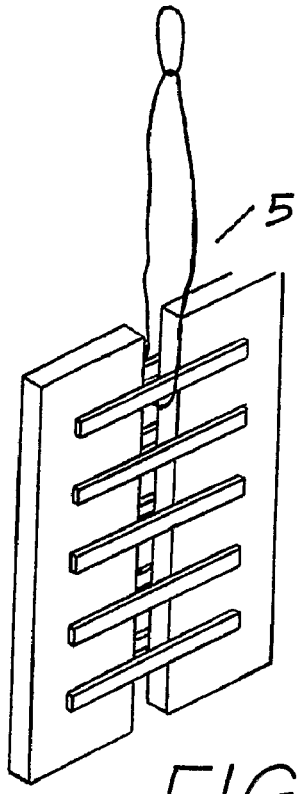
Figure 17:
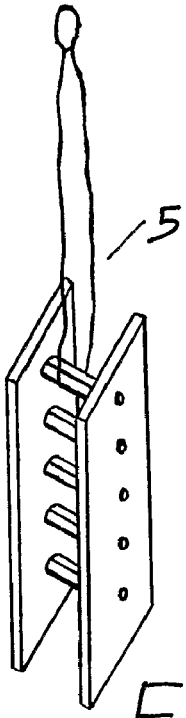
Figure 18:
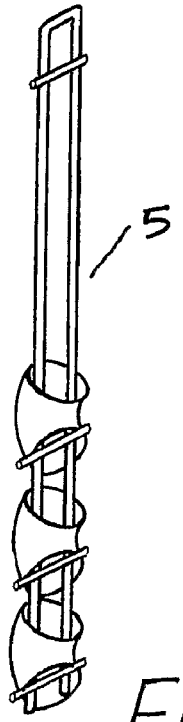

With regard to the furnace closing system object of this present invention, a mere lid acting by itself does not close the pit furnace 1, as in the conventional systems. For closing the pit furnace 1, two beams 2 are used, as well as A304* stainless steel square iron bars 4 having a diameter of 2 inches, laid across the border of the furnace structure 1 and supported over the beams 2.

Its construction is simple and its cost is very reduced in relation to the conventional furnaces, and its walls have a very reduced thickness in relation to the conventional pit furnace.

The closing means proposed by the present invention comprise the following: a) pieces of cloth wrap for high temperature are used for closing the furnace 3, cut in a manual way or with the use of a sharp blade; b) a species of box in a stainless steel screen was further developed, folded and having a ring, which is filled in with remains of wraps; c) another form used is a bipartite lid in a thin plate with wraps fixed to it and a cut for the upper part of the supporting device of the parts to pass.

This system is restricted so as to contain a single load, on the contrary of the other means, which allow for conditioning several parts in the same furnace.

In the present invention, the supports for the parts to be submitted to the high temperature are "cage"-like devices 5, which are suspended inside the furnace and supported on the two beams 2, not resting on the floor of the furnace, and several are the conditioning systems: a) the very light weight parts may be fastened with a 3.2 mm wire approximately; b) the medium weight and heavy parts will follow a table with the drawings of the more evident forms of conditioning; and c) other parts may be hung through welded rings in the parts themselves.

The pit furnace referred to herein has thermopairs, which may be in contact with the part entering into the mouth of the furnace, or may be loose ones, and their heating ends are located in the central direction of each heating zone (thermopairs bar).

Yet with regards to the conventional system, this one allows protection gas to be used, and the surface is protected and the service may be performed on totally milled parts.

In the system object of the present invention, gas is not used; therefore, it is indicated to treat raw or previously milled parts; however, the advantages are numberless, mainly since it does not use refractory stainless steel baskets and, therefore, the operating cost is very reduced, generating the single means for making very large parts and very heavy ones, since they are hung in beams 2 external to the furnace 1 and inasmuch as the beams 2 are not submitted to the heat, they are always cold and always resistant to support weight.

As a variant, a pit furnace is forecast having oil heating and having a rectangular format, which is coated with refractory bricks fixed with stainless steel pins. An end of the pin is welded in the plate of the furnace and the other part is welded in a square plate, which may contain a possible movement of the vertical walls of the furnace.

The burners may be fed with diesel oil or with viscous fuel oil. The conditioning of the parts and their being put inside the furnace are similar to the one already described with regards to the tubular pit furnace, as it is further similar to the closing system with cloth wraps for high temperature or with boxes having rings in stainless steel screen, folded, and wraps.

FIG. 19, 20, 21, 21A, 22, 22A, 23 and 23A represent variations of complementary lids for closing the pit furnace 1, as proposed.

The objective of the variations presented in the aforementioned figures is that of providing other options of closure through several forms of complementary lids, with variations that offer the same technical advantages, both practical and functional, of the constructs depicted in FIGS. from 2 through 18.

Figure 19:
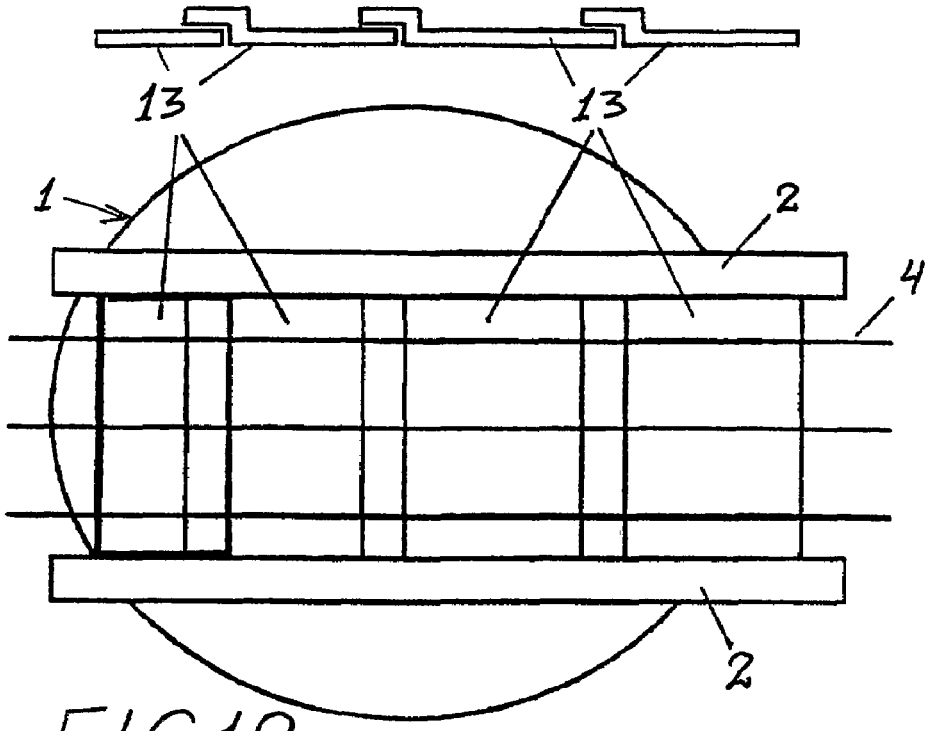
FIGS. 19, 20, 21, 21A, 22, 22A, 23 and 23A represent variations of complementary lids for closing the pit furnace yet within the scope of this patent.

FIG. 19 depicts a variant in which the opening between the beams 2 is covered with wraps 3 and said wraps are supported over square A304" stainless steel bars 4, having a diameter of 2 inches.

Figure 20:
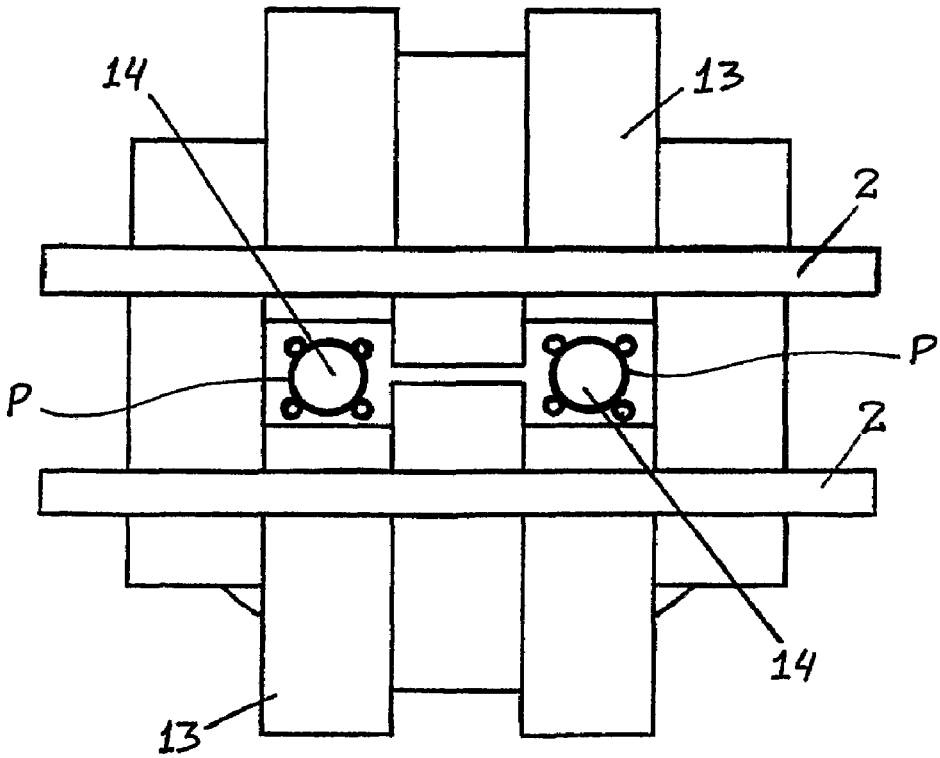

In FIG. 20, the fact that the opening between the beams 2 is closed with stainless steel coin screen plates 13 may be appreciated, filled in with wraps in flocks. It is observed that the plates touch each other when there is no device for supporting the parts 14, and when there is the device for supporting the parts, the plates get closer to each other at the maximum point, until they touch said device. All of the other openings are covered with wrap flocks or pieces of wrap.

Figure 21:
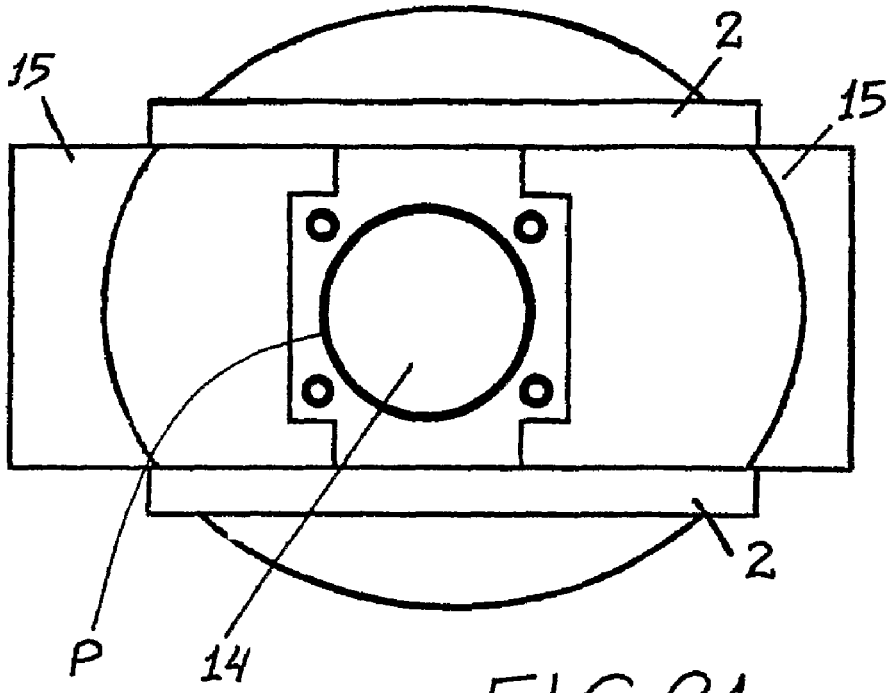

FIG. 21 depicts the fact that the lid is bipartite 15 and the two parts touch each other when there is no load, and, when there is load, they touch the supporting device of the parts 14, leaving the device's internal space to be covered with wrap.

Figure 21A:
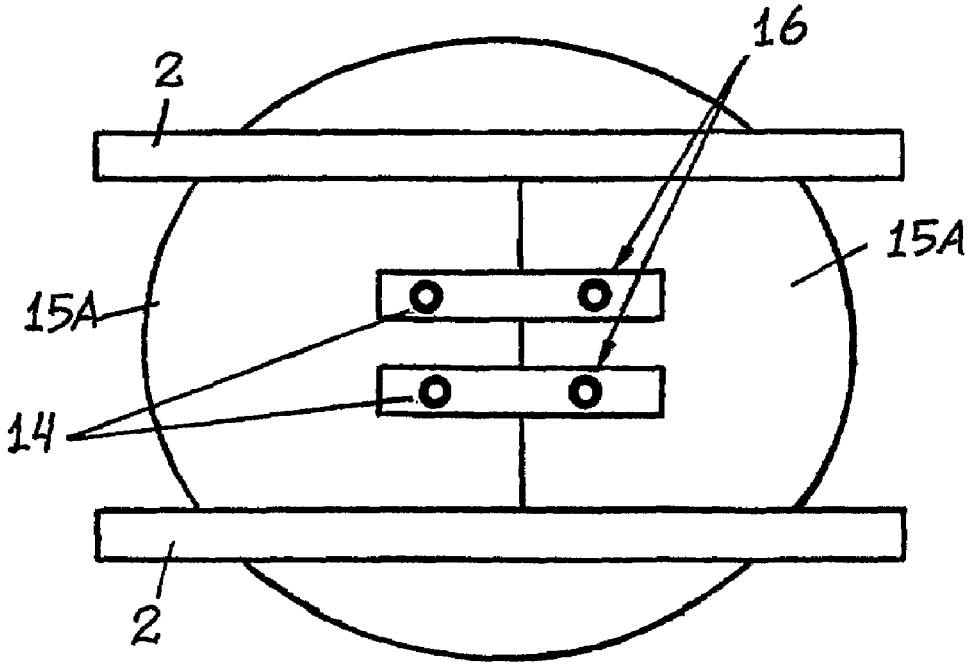

FIG. 21A depicts a variation of the lid of FIG. 21. The bipartite lid, indicated in this case by reference 15, has a cut 16, which provides a perfect mate with the bars of the device for supporting the parts 14.

The lid system of FIG. 21 is used for occasions in which only one device for supporting the parts will be put into the furnace, while the lid system of FIG. 21A serves for when the device for supporting the parts 14 always has the same dimensions.

Figure 22:
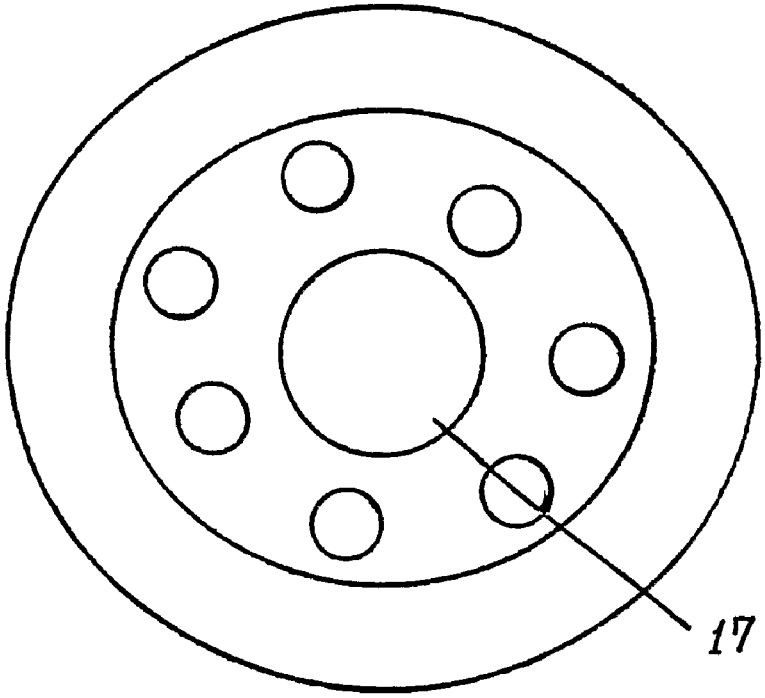
Figure 22A:
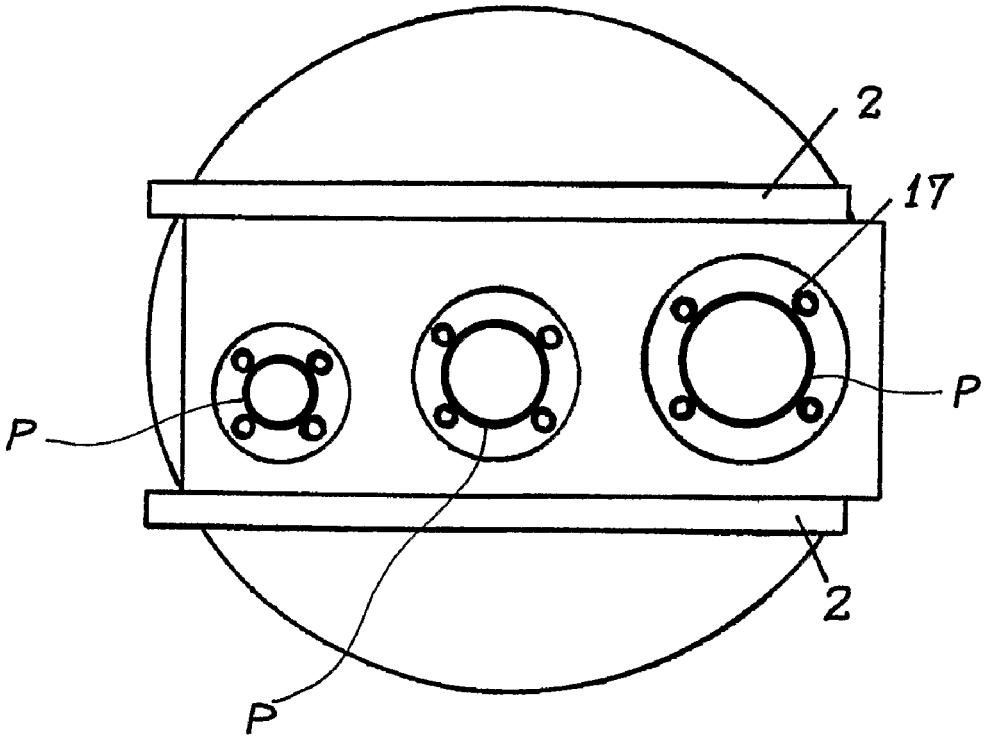

FIGS. 22 and 22A depict lid systems that are used in the situations in which thin and hung parts are put into the furnace without the device for supporting the parts, that is, when the parts are fastened to the ring by means of weld. After the part is removed, it is closed with lids with the same measures of the holes 17.

Figure 23:
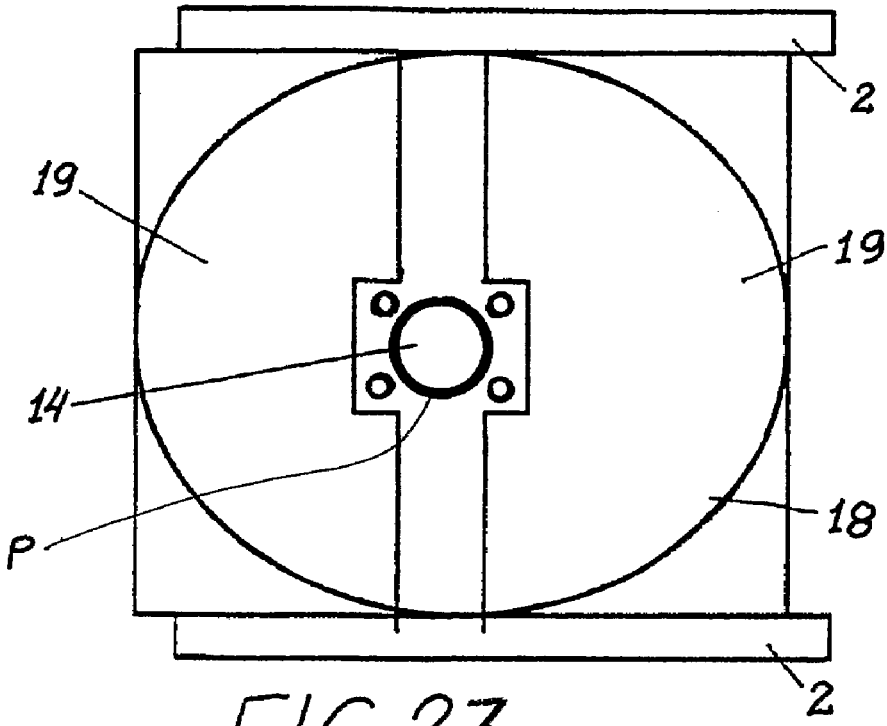

FIG. 23 depicts the fact that the beams 2 may be laid close to the internal diameter of the mouth 18 of the furnace. There will be, in this case, a bipartite door 19 with rollers so as to aid with the displacements outwards or inwards. When the door is closed, the device for supporting the parts 14 must have standard measures and a square plate so as to complete the closure.

Figure 23A:
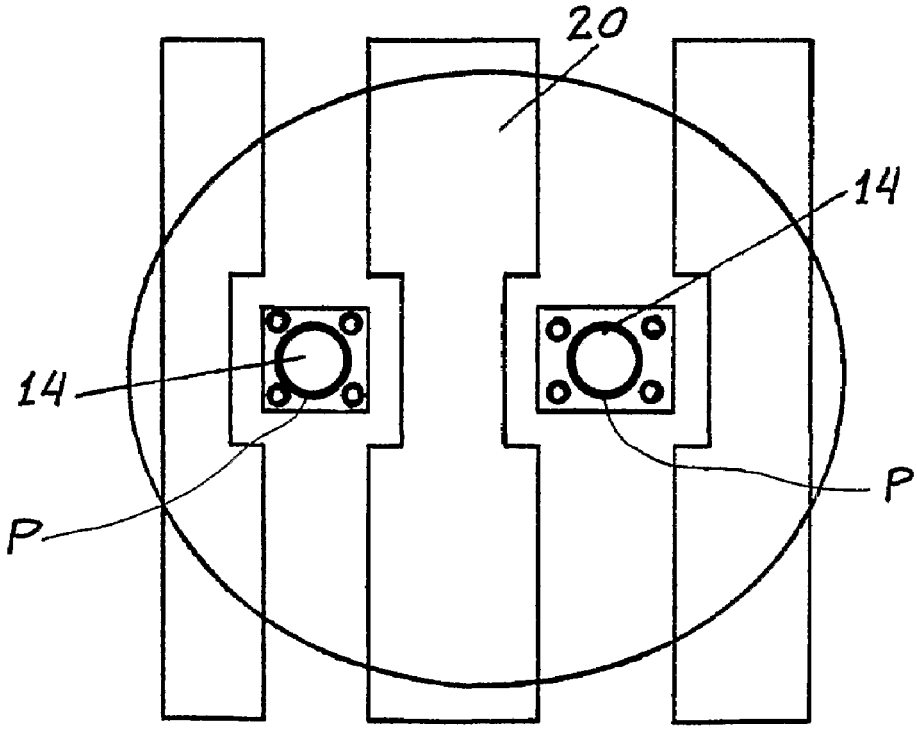

FIG. 23A depicts the condition of the putting into the furnace two devices for supporting the parts, in which a plate 20 that is adapted between the two devices for supporting the parts 14 is shown.

In the several figures that illustrate the variations of complementary lids for closing the furnace 1, such as proposed, that is, in figures from 19 through 23A, the parts that are laid on the devices for supporting the parts 14 are indicated by reference P.

The invention claimed is:

1. A pit furnace closing system, comprising:

a furnace structure having an opening at an upper end thereof;

two beams disposed in spaced parallel relation above the furnace structure;

a bipartite lid having a cut;

a planar stainless steel screen formed to mate with the cut of the bipartite lid, the planar stainless steel screen having a through-hole formed therethrough; and, a support device hanging from the planar stainless steel screen with a superior portion extending out of the furnace structure, the superior portion being substantially removed from the heat of the furnace structure, wherein, parts to be tempered are suspended on an inferior portion of the support device inside the furnace.

2. The pit furnace closing system, according to claim 1, the furnace structure further comprising thermopairs having heating ends disposed in a center of a heating zone.

3. The pit furnace closing system, according to claim 1, wherein the two beams are not submitted to the heat and remain substantially at an ambient temperature.

4. The pit furnace closing system, according to claim 1, the furnace structure providing for oil heating and having a rectangular format, an inner surface of the furnace structure being coated with refractory bricks fixed with stainless steel pins, wherein an inferior end of each pin is welded to an inferior plate of the furnace structure and a superior end is welded to a superior plate.

5. The pit furnace closing system, according to claim 1, wherein gaps between the through-hole and the support device being filled in with wraps.

6. The pit furnace closing system, according to claim 1, wherein in the case of two supporting devices being employed for supporting the parts, a plate being interposed in coplanar arrangement between the two supporting devices.

* * * * *